US006775959B1

(12) United States Patent
Lasson

(10) Patent No.: US 6,775,959 B1
(45) Date of Patent: Aug. 17, 2004

(54) METHOD OF PRODUCING A PACKAGING CONTAINER PROVIDED WITH AN OPENING ARRANGEMENT

(75) Inventor: Rolf Lasson, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/088,680

(22) PCT Filed: Sep. 21, 2000

(86) PCT No.: PCT/SE00/01833

§ 371 (c)(1),
(2), (4) Date: Jun. 4, 2002

(87) PCT Pub. No.: WO01/21390

PCT Pub. Date: Mar. 29, 2001

(30) Foreign Application Priority Data

Sep. 22, 1999 (SE) ..... 9903415

(51) Int. Cl.[7] ..... B65B 43/26
(52) U.S. Cl. ..... 53/492; 53/133.1
(58) Field of Search ..... 53/133.1, 492; 493/87

(56) References Cited

U.S. PATENT DOCUMENTS

| | | | | |
|---|---|---|---|---|
| 3,455,214 A | | 7/1969 | Stark et al. | |
| 3,737,092 A | | 6/1973 | Rausing | |
| 3,795,359 A | | 3/1974 | Rausing | |
| 3,943,682 A | | 3/1976 | Rausing | |
| 4,017,247 A | | 4/1977 | Soukup et al. | |
| 4,027,455 A | * | 6/1977 | Rausing et al. | 53/412 |
| 4,074,961 A | | 2/1978 | Reil | |
| 4,151,024 A | * | 4/1979 | Ohlsson | 156/69 |
| 4,203,796 A | * | 5/1980 | Larsson | 156/504 |
| 4,364,220 A | * | 12/1982 | Rausing | 53/411 |
| 4,384,440 A | * | 5/1983 | Ohlsson | 53/412 |
| 4,387,547 A | | 6/1983 | Reil | |
| 4,410,128 A | | 10/1983 | Rausing | |
| 4,723,391 A | * | 2/1988 | Ashley et al. | 53/412 |
| 4,819,406 A | * | 4/1989 | Redmond | 53/51 |
| 6,293,432 B1 | * | 9/2001 | Hartwall | 222/105 |

FOREIGN PATENT DOCUMENTS

| | | |
|---|---|---|
| EP | 0199830 | 11/1986 |
| EP | 0234805 | 9/1987 |
| SE | 452874 | 12/1987 |
| WO | 98/14317 | 4/1998 |
| WO | 99/43561 | 9/1999 |

* cited by examiner

*Primary Examiner*—Eugene Kim
(74) *Attorney, Agent, or Firm*—Burns, Doane, Swecker & Mathis, L.L.P.

(57) ABSTRACT

The disclosure relates to a method of producing packages with opening arrangements and of the type which has a hole prepared in the package wall through which the package is intended to be emptied of its contents. A web of paper or paperboard is coated on its one side with liquid tight coating of plastic and, on its other side, with a metal foil which serves as oxygen gas barrier and which is bonded to the paper or paperboard layer by an adjacent adhesive layer. The coated web or packaging blank is thereafter transported further to a packing and filling machine where the web is provided with emptying-preparatory holes before being reformed into finished packages in a conventional manner. The emptying-preparatory holes are made only partly through the web in that the web is first incised or cut along closed lines through the outer plastic coating and the paper or paperboard web down to, but not through, the subjacent metal layer, and the parts of the web enclosed by the incision lines being thereafter removed from the web with the aid of a vacuum. The removal of the above-mentioned web parts is facilitated in that the packaging blank is selectively heated in order wholly or at least party to break the bond between the metal foil and the paper or paperboard layer within the region of these parts.

9 Claims, 3 Drawing Sheets

METHOD OF PRODUCING A PACKAGING CONTAINER PROVIDED WITH AN OPENING ARRANGEMENT

FIELD OF THE INVENTION

Figure 1:
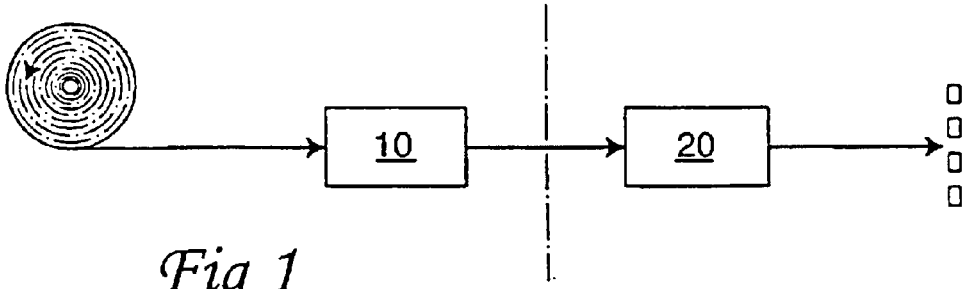

The present invention relates to a method of producing packages provided with an opening arrangement and of the type which has an emptying hole prepared in the package wall and through which the package is intended to be emptied of its contents, the method comprising the steps of coating one side of a web of paper or paperboard with a liquid-tight coating, of plastic, and the other side with a foil or coating of metal which serves as oxygen gas barrier and which, by means of a layer of sealing plastic or other suitable adhesive, is bonded to the paper or paperboard web; of making emptying-preparatory holes in the thus coated paper or paperboard web and thereafter reforming the packaging blank provided with the hole into individual packages provided with an opening arrangement.

BACKGROUND OF THE INVENTION

Within the packaging industry, use is now often made of packages of single-use disposable type for the transport and handling of liquid foods, and a very large group of these so-called single-use disposable packages is produced from a packaging laminate which comprises a paper or paperboard layer and liquid-tight coatings of plastic on both sides of the paper or paperboard layer. Examples of commercial packages of this type are TETRA BRIK® and TETRA REX®.

For foods which have a relatively rapid turnover in retail outlets and, as a result, relatively short shelf-life in their package, a packaging laminate solely of paper or paperboard and outer liquid-tight coatings of plastic is often sufficient to impart to the packed food the requisite product protection throughout its entire storage life from filling to consumption. On the other hand, for more perishable and storage-sensitive foods which are intended to be able to be stored for a relatively lengthy period of time in their packages, it is necessary that the packaging laminate be supplemented with at least one additional layer in order to make for extended shelf-life. In particular, it is necessary that the package be sufficiently tight in order, during the entire storage life of the packed food in its unopened package, to prevent the penetration of oxygen gas which could very rapidly cause deterioration in the food if it came into contact with the food.

In order to make for the packing of such perishable, storage- and oxygen gas-sensitive foods with extended shelf life, the packaging laminate is therefore normally supplemented with at least one additional layer of metal or plastic of other type than that employed in the outer plastic coatings of the packaging laminate. The most common packaging laminate for this purpose includes, as the above-mentioned additional layer, an aluminum foil which is practically entirely impermeable to oxygen gas and which, moreover, possesses the advantageous property that it makes possible inductive thermosealing which is a simple, but efficient method of rapidly obtaining mechanically strong and tight sealing joints or seams when the sheet- or web-shaped packaging blank is reformed during the package production operation.

In addition to the requisite mechanical and physical properties so as to make for lengthy storage of foods with good shelf life, it is also desirable from the point of view of the consumer that the package can be easy to open when it is time to empty the package of its contents. In order to satisfy this need and provide a conveniently openable package, the package is therefore provided with some type of arrangement which facilitates opening and which may either be integral in or be a separate part of the package.

An extremely well-known and well-functioning opening arrangement includes an emptying hole prepared in the paper or paperboard layer of the package wall and which is closed from inside and outside by respective surrounding layers in the package wall. In order to facilitate exposure of the emptying hole when the package is to be opened, the opening arrangement normally includes a separate opening strip fixedly secured on the outside of the package wall and whose removal entails that the subjacent part of the package wall is entrained and torn off along the incision edges of the hole so that the entire hole is exposed.

Other types of exteriorly applied opening arrangements for facilitating exposure of an emptying hole prepared in the package wall are also known in the art, but since they do not constitute a germane part of the present invention, they need not be described in greater detail here in order to understand the present invention.

A packaging blank for a packaging container of the type described by way of introduction is produced, according to a conventional method, from a rolled web of paper or paperboard. The rolled web is unwound from the reel and is led through a printing station where the web is provided with the desired decorative artwork and possibly other printing markings relevant for subsequent web operations. The printed web is thereafter led further to a mechanical processing station where the web, in a per se known manner, is given the desired pattern of crease lines and also provided with through-going holes of the desired size and configuration which correspond with the emptying opening of the finished package. From the processing station, the web is thereafter led further to a coating station where the web is coated on both its sides with liquid-tight plastic coatings, and possibly additional layers necessary for the packaging purpose, e.g. an aluminum foil (Alifoil) in that case when the web is later to be used for the production of packages for, for instance, oxygen gas-sensitive products. Finally, from the coating station, the web is wound up on package magazine reels for storage or further transport to a packing machine where the web is supplemented with separate opening details in the areas of the prepared emptying hole, and is thereafter formed, filled and sealed to form individual consumer packages provided with an opening arrangement.

Packages produced according to this conventional method generally function well in those cases when the packaging laminate merely consists of paper or paperboard and outer coatings of plastic, while corresponding packages in which the packaging laminate also includes an aluminum foil show a tendency to lose tightness properties against oxygen gas or right from the outset display deteriorating tightness properties against oxygen gas, in particular within the area of the emptying hole prepared in the package wall. While the packages in most cases maintain sufficient oxygen gas tightness to impart to the packed product satisfactory protection during at least a major part of the storage life of the product in the unopened package, it is naturally a need in the art to be able to produce packages which right from the outset display a high level of oxygen gas tightness which, moreover, is maintained during the remaining part of the storage life of the product in its package.

According to another conventional method, packaging containers provided with an opening arrangement are produced from a similar packaging blank to that described above, but which, unlike the previous packaging blank, is not provided with any through-going emptying hole before the coating with the additional layer of plastic and aluminum. In this case, the emptying-preparatory holes are made on the ready-coated packaging blank by means of punching tools in connection with the packing and filling machine, where after the thus provided holes are closed with the aid of an applicator which applies a sealing plastic patch or strip over the hole before the packaging blank is led in and reformed into packages in the packing and filling machine.

Packages produced according to this conventional method function well also in that case when the packaging laminate includes an aluminum foil, and such packages are moreover conveniently openable, but one serious drawback is that the method requires extremely accurate register maintenance and therefore complicated technical equipment in order to place the emptying holes in the correct position in relation to the printed artwork and crease line pattern of the packaging blank and in order to apply the sealing plastic patch or plastic strip in such a manner that it impenetrably but tightly seals the hole provided in the package wall.

SUMMARY OF THE INVENTION

One object of the present invention is therefore to provide an indication of how the above-described shortcomings and drawbacks inherent in the prior art technology may be obviated or at least considerably reduced.

A further object of the present invention is to provide a method of producing packaging containers, provided with an opening arrangement, of the type described by way of introduction which, unlike the prior art packaging containers, right from the outset display an oxygen gas tightness which is sufficiently high and stable so as to make possible long-term storage of a perishable, storage- and oxygen gas-sensitive product with good shelf life.

Yet a further object of the present invention is to provide a method of producing packaging containers, provided with an opening arrangement, with increased flexibility for an individual manufacturer of packages.

These objects are attained according to the present invention by the method as defined in appended claim 1.

One key difference between the method according to the present invention and the former method as described above is, thus, that the provision of the emptying hole in the method according to the present invention is to take place on the ready-produced packaging blank, and hence not only on the paper or paperboard web in connection with the production of the packaging blank, as in the prior art conventional method.

One key difference between the method according to the present invention and the second conventional method as described above is further that the emptying holes, in the method according to the present invention, are made only partly through the packaging blank, i.e. from the one side of the packaging blank through the outer plastic coating and the paper or paperboard layer down to, but not through, the subjacent aluminum foil which, thus, together with the outer plastic coating on the other side of the packaging blank, remain unpenetrated or intact on the packaging blank.

As a result of this unique partial hole provision on the finished packaging blank, inter alia the advantage will be afforded that the unruptured or intact aluminum foil (which is nevertheless already present in the packaging blank) can effectively be utilized for oxygen gas-tight closure of the emptying hole which, granted, can but need not be closed separately with an extra plastic strip or plastic patch as in the prior art method.

The deteriorated oxygen gas-tightness in prior art packages provided with opening arrangements of the above-described type, in particular in the region of the emptying opening prepared in the package wall is because of the fact that it has been difficult for process-related reasons, to achieve a strong internal bonding of the individual layers included in the packaging laminate, i.e. the aluminum foil and the plastic, within this region. When the paper or paperboard web with holes provided is coated with aluminum foil and plastic, and is, in connection with, or immediately after such coating led through the nip between a press roller and a counter-pressure roller in order, under pressure, to compress and bond the layers to one another, the necessary compression pressure against the web is attained only in those web areas which are not hole-punched, i.e. where the web is wholly continuous, while but a lower (insufficient) pressure is attained in remaining areas of the web, i.e. in the regions of the punched holes.

On the other hand, in the method according to the present invention, where the paper or paperboard web lacks the provision of holes, the same requisite pressure can be attained transversely across the entire web and within all regions of the web.

The partial provision of the emptying-preparatory holes in the well-integrated packaging web according to the present invention may be put into effect mechanically with the aid of punching tools which, at selected points, punch or cut incision lines of the same size and configuration as the desired emptying opening down to a pre-set depth in the packaging web, e.g. down to the aluminum foil beneath the paper or paperboard layer, where after the web portions defined by the incision lines (so-called confetti) are removed from the web for the formation of partly provided emptying holes on the upper side of the packaging web.

According to the present invention, the partly provided emptying holes are preferably realized with the aid of laser equipment which directs a cutting laser beam along a line corresponding to the opening configuration of the emptying opening down to the desired depth in the packaging material, i.e. through the plastic coating, and the paper or paperboard layer down to the subjacent aluminum foil, from the one side of the packaging web. The advantage in laser cutting as compared with mechanical punching is that laser cutting is mechanically contactless with the moving packaging web and therefore does not involve any moving mechanical components which are worn as a result of physical contact with the moving packaging web or with any other moving machine part. A further major advantage is that a laser beam is easy to direct and set to the desired cutting depth during ongoing processing, without the need to stop the packaging web or otherwise arrest operation.

The parts of the packaging web defined by the incision lines are thereafter removed in a conventional manner by means of vacuum which sucks or draws off these from the packaging web and leaves the partly through-going holes in the packaging web.

In order to facilitate this removal by suction or drawing of the confetti from the packaging web, heat is applied to the web simultaneously within the pertinent confetti regions, whereby the sealing plastic or adhesive between the paper or paperboard layer and the aluminum foil is melted and, as a result, the confetti may more easily release is grip on the subjacent aluminum foil.

Preferably, the packaging web is heated within the selected regions by induction heating which is an efficient and reliable heating method also at extremely high web speeds.

The partly through-going emptying holes in the packaging web can thereafter be sealed with separate opening strips which are fixedly sealed on the one side of the packaging web in a mechanically strong, but rupturable sealing joint around the entire opening contour of the hole. Alternatively, or in addition, the exposed fiber incision edges may be impregnated or covered with a water-repellent coating prior to the application of the opening strips.

According to the present invention, it is further possible, possibly after a preceding impregnation of the exposed fiber incision edges within the regions of the provided emptying holes, to form, fill and seal packages from the hole-provided packaging web and thereafter apply separate, e.g. injection moulded arrangements above each respective emptying hole on each individual package in connection with the package's departing from the packing and filling machine. Such opening arrangements are known to persons skilled in the art and occur in a multiplicity of different variations and, therefore, need not be described in greater detail in this context.

DESCRIPTION OF THE DRAWINGS AND OF THE INVENTION

Further advantageous details and characterizing features of the present invention will be apparent from the following detailed description with reference to the accompanying Drawings.

FIG. 1 is a block diagram which, in highly simplified form, shows the two main stations 10 and 20 involved for carrying the method according to the present invention into effect, as well as how these two main stations are interrelated with each other. In the illustrated block diagram in FIG. 1, reference numeral 10 generally refers to a first main station or conversion plant, where sheet- or web-shaped packaging blanks are produced in per se conventional manner and using per se conventional means for further transport to a second main station 20 where the sheet- or web-shaped packaging blanks are, with the aid of packing and filling machines, finally reformed into finished consumer packages. The two main stations 10 and 20 may be in line with each other, but are, in practice, always located at geographically wholly separate sites from one another, as intimated by the broken division line between the two stations.

Figure 2:
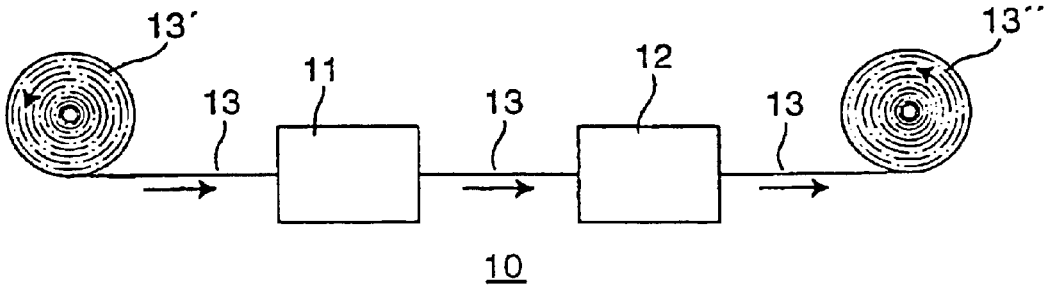

FIG. 2 is a block diagram of the first main station 10 for producing a rolled web-shaped packaging blank with the desired decorative artwork and desired pattern of crease lines facilitating folding. The first main station 10 in the illustrated generic example includes a first processing station 11 and a second processing or coating station 12 which together produce the web-shaped packaging blank from a magazine reel 13' of paper or paperboard shown furthest to the left in FIG. 2.

From the magazine reel 13', a paper or paperboard web 13 is unwound and is led into the first processing station 11 where the web is provided on its one side with the desired decorative artwork of printing ink, and also control- or process markings relevant to subsequent processing operations of the web, at the same time as the web 13 is also provided in a conventional manner with the desired pattern of crease lines which facilitate folding.

From the first processing station 11, the web 13 is led to the second processing station 12 where the web is coated on its one side with plastic, preferably polyethylene, and on its other side with an aluminum foil which serves as gas barrier and which is bonded to the paper or paperboard layer of the web by a layer of sealing plastic or other suitable adhesive applied between the paper or paperboard layer and the aluminum foil. At the same time, the web is coated with at least one additional layer of plastic in order to cover the exposed aluminum foil and produce a web-shaped, oxygen gas- and liquid-tight packaging blank 13 which is thereafter wound up on a finished packaging magazine reel 13".

From the main station 10, possibly after intermediate storage, the finished packaging magazine reel 13" is thereafter transported to the second main station 20 for the production of packages provided with easily opened opening arrangements.

Figure 3:
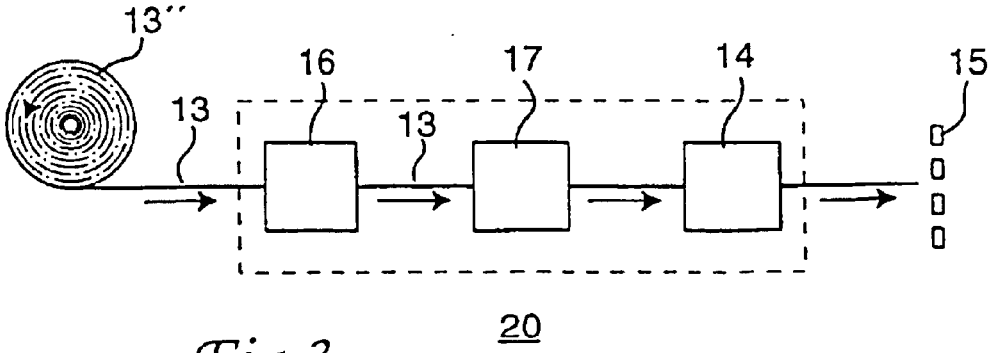

FIG. 3 is a general block diagram of the second main station 20 which, in the illustrated embodiment, comprises a packing and filling machine 14 of the type which, from a sheet, or web-shaped packaging blank, both forms, fills and seals finished packages 15. The packing and filling machine 14 further displays, at its infeed end, an apparatus 16 for cutting through the packaging blank along a substantially closed line whose size, configuration and placing correspond to the contours and placing of an emptying opening prepared in the finished package. After, or in connection with the apparatus 16, the packing and filling machine moreover displays an apparatus 17 by means of which the parts (the confetti) of the packaging blank defined by the incision lines are removed for the formation of emptying holes which are partly through-going in the packaging blank.

In operation, the web-shaped packaging blank 13 is unwound from the magazine reel 13" placed at the infeed end of the packing and filling machine 14 and is led to the apparatus 16 where the packaging blank is provided with incisions in register with the pre-printed decorative artwork and the crease line pattern of the packaging blank along a substantially closed line which extends from the one side of the packaging blank through the one outer plastic coating and the paper or paperboard layer down to the subjacent aluminum foil. From the apparatus 16, the packaging blank 13 is led further the apparatus 17 where the parts of the packaging blank defined by the incision lines are removed for the formation of partly through-going emptying holes in the packaging blank, before this is led into the packing and filling machine 14 proper for the production of filled, sealed packages 15 with opening arrangements including emptying holes provided in the package wall.

The apparatus 16 for applying emptying-preparatory incision lines in the packaging blank may be a conventional punching tool which is configured and adjusted such that it cuts in incision lines to the desired depth in the passing packaging blank.

According to the present invention, the apparatus 16 is preferably a laser apparatus which directs a laser beam of such intensity and wave length at the packaging blank that the beam cuts through the outer plastic coating and the paper or paperboard web down to, but not through, the aluminum foil from the one side of the packaging blank. A laser apparatus enjoys the major advantage over a mechanical punching tool that it reliably cuts down to the desired depth in the packaging blank and that, moreover, it can rapidly and readily be switched for cutting incision lines of optional size and configuration, without the process needing to be arrested for this switching operation.

The apparatus 17 for removing the parts of the packaging blank enclosed by the incision lines includes or is connected to a vacuum source with the aid of which the parts are sucked or drawn free from the packaging blank for the formation of emptying holes partly through-going in the packaging blank and which, from the other side of the packaging blank, are closed by the intact or unruptured aluminum foil.

A more reliable and efficient removal by suction or drawing of the confetti is attained according to the present invention if the packaging blank, in connection with the removal operation, is selectively heated within the relevant hole regions in such a manner that the sealing plastic or adhesive between the paper or paperboard layer and the aluminum foil wholly or at least partly melts and the bond between the paper or paperboard layer and the aluminum foil is thereby weakened.

Since the packaging blank 13 includes aluminum, the bond-breaking heating may be readily realized by induction heating of the aluminum foil with the aid of conventional induction heater elements which rapidly heat the packaging blank to a temperature corresponding to or slightly exceeding the melting temperature of the relevant sealing plastic.

As was described previously, the packing and filling machine 14 may also include an applicator (not shown) in association with or immediately after the confetti-removing apparatus 17 in order to apply a separate opening strip or the like over the exposed end of the partly provided emptying hole. Alternatively, the packing and filling machine 14 may include an apparatus (not shown) for applying a water-repellent impregnation agent for covering and protecting the exposed fiber incision edges within the regions of the above-mentioned emptying holes.

Finally, the packing and filling machine 14 may also be equipped with or connected to an apparatus (not shown) placed at the discharge end of the packing and filling machine and with which separate opening arrangements may be applied on the finished packages over the (possibly covered) emptying holes prepared in the package wall.

Suitable opening arrangements for this purpose are previously known to persons skilled in the art and occur in a multiplicity of different forms and configurations. Each type of such opening arrangement capable of facilitating puncturing and/or removal of the arrangements sealing the hole, including the aluminum foil, may be employed in the present invention.

Figure 4:
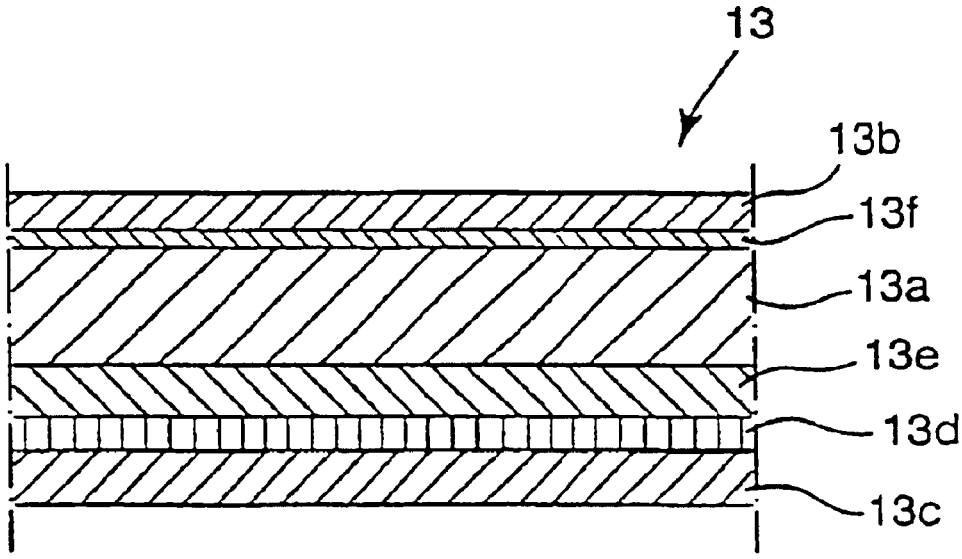

With reference to FIGS. 4 and 5A–5C, one particularly preferred embodiment of the method according to the present invention will now be described in connection with a packaging blank of a laminated packaging material with the structure which is schematically shown in FIG. 4. The same reference numerals as previously employed have been employed for the same or corresponding components in FIGS. 4 and 5. However, in certain cases lower case letters have been added after the reference numeral in order to designate separate pares of the relevant components.

FIG. 4 thus schematically shows a cross section of a sheet- or web-shaped packaging blank of a laminated packaging material carrying the generic reference numeral 13. The packaging blank 13 includes, in this example, a paper or paperboard layer 13*a* and outer, liquid-tight coatings 13*b* and 13*c* on both sides of the paper or paperboard layer 13*a*. Between the paper or paperboard layer 13*a* and the one outer plastic coating 13*c*, the packaging blank has an aluminum foil 13*d* which serves as oxygen gas barrier and which is bonded to the paper or paperboard layer 13*a* by means of an interjacent layer 13*e* of sealing plastic or adhesive of known type. The paper or paperboard layer 13*a* further has decorative artwork 13*f* of printing ink which is covered by, but visible through, the outer plastic coating 13*b* on the other side of the packaging blank 13. While not being particularly shown in FIG. 4, the packaging blank 13 is moreover provided with the desired pattern of crease lines which facilitate folding, and also process-related control markings, so-called bar codes, in register with the printed decorative artwork.

Figure 5A:
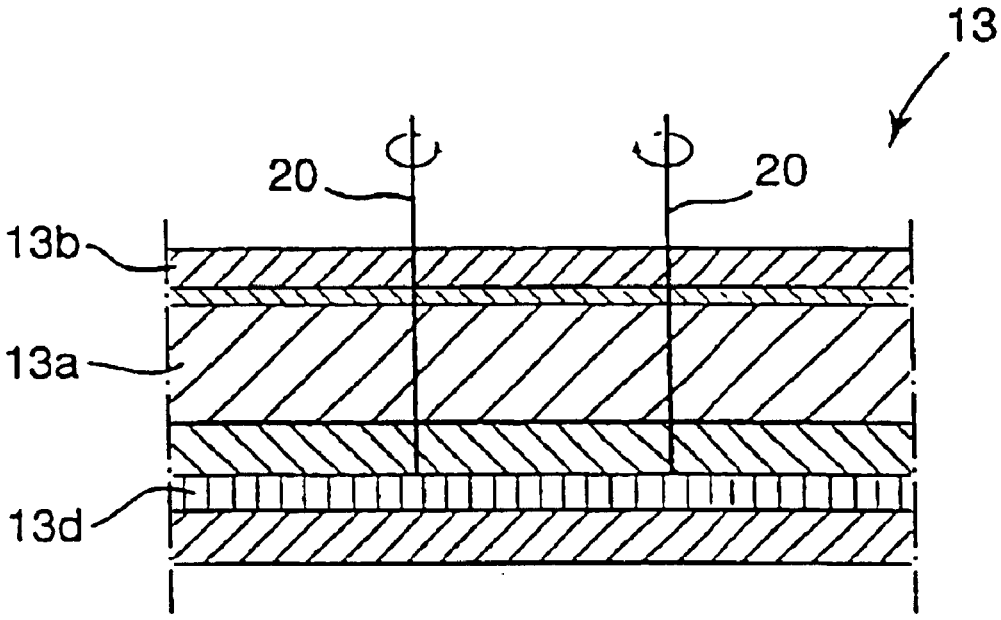
Figure 5B:
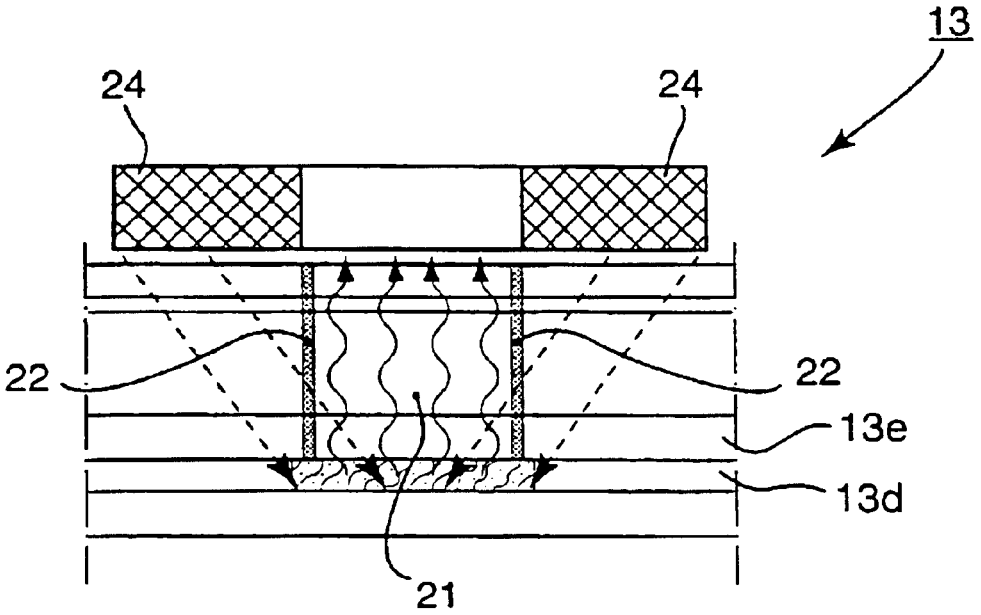
Figure 5C:
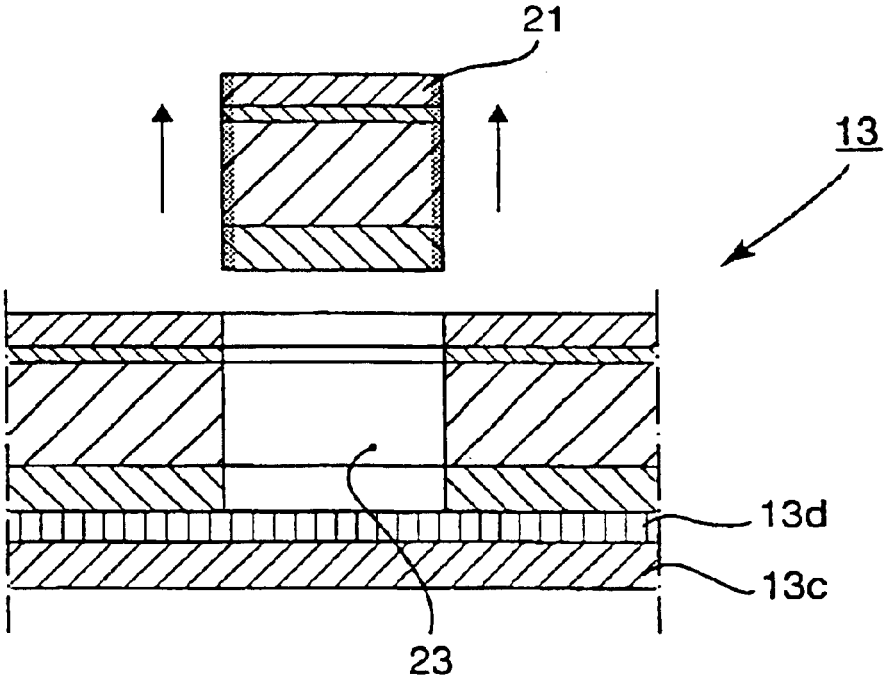

A web-shaped packaging blank 13 with the structure illustrated in FIG. 4 is processed according to the preferred embodiment of the present invention in the manner which is schematically illustrated in FIGS. 5A–5C for producing packages provided with opening arrangements of the type which has an emptying hole prepared in the package wall through which the packages are intended to be emptied of their contents.

The web-shaped packaging blank 13 is unwound from a magazine reel 13" placed at the packing and filling machine 14 (FIG. 3), and is led to a laser apparatus 16 which directs a laser beam 20 (FIG. 5A) of adjustable wavelength and intensity at the one side of the passing packaging laminate 13 in order to cut an incision along a line corresponding to the desired opening contour of the emptying hole in the package wall. By the correct setting of the wavelength and intensity of the laser beam 20, the laser beam 20 burns or cuts through the outer plastic coating 13*b* and the paper or paperboard layer 13*a* down to, but not through, the subjacent aluminum foil 13*d*. Such apparatuses equipped with adjustable laser beams are well-known to persons skilled in the art and are not likely to need any detailed description here.

The thus incised packaging blank 13 is thereafter led further to the confetti-removing apparatus 17 (FIG. 3) where those parts 21 of the packaging blank which are defined by the incision lines 22 are removed by suction or drawing off by means of vacuum (schematically illustrated by arrows in FIG. 5C) for the formation of emptying holes 23 partly through-going in the packaging blank 13 and closed from beneath by the intact aluminum foil 13*d* of the packaging blank 13, including the outer plastic coating 13*c*.

In order to facilitate and make for a reliable removal of the parts 21 from the packaging blank 13 by suction or drawing, the packaging blank is heated immediately prior to or in connection with this suction or drawing operation, as illustrated in FIG. 5B, by selective induction heating by means of induction heater elements 24 which heat the aluminum foil 13*d* directly to a suitable temperature for melting or softening the layer 13*e* of sealing plastic or other suitable adhesive. As a result of this induction heating, moisture present in the packaging blank (moisture content of approx. 5–7%) is forced down towards the aluminum foil, where the moisture reverses and, by a so-called blistering phenomenon, assists in releasing the confetti fraction 21 from the packaging blank 13.

The combination of laser cutting and removal by suction or drawing during simultaneous heating of the packaging blank within selected areas in the method according to the present invention enjoys the unique advantage that it may be applied on a running packaging web without requiring any complicated extra equipment for guiding the cutting laser beam in register with the pre-printed decorative artwork and the crease lines of the packaging blank. Moreover, it ensures an efficient and rapid processing of the packaging web at the same time as it has an inherent ability to be able to be adapted for accommodating varying types and configurations of emptying holes while in ongoing operation, without the packaging web needing to be stopped or operation otherwise needing to be disrupted for such a switching operation.

It will thus be apparent from the foregoing description that the present invention satisfies the previously established objects and needs and makes for the production of packages provided with emptying arrangements in a simple, efficient manner using existent conventional equipment. While the present invention has been described in particular with reference to a packaging blank including an aluminum foil serving as a gas barrier, the present invention is naturally not restricted exclusively to such packaging blanks. Instead of an aluminum foil, the packaging blank could just as well include a coating of aluminum applied by vacuum deposition. To a person skilled in the art, it will further be obvious that other metals than aluminum may also be employed as gas barrier in the packaging blank, without departing from the inventive concept as this is defined in the appended Claims.

What is claimed is:

1. A method of producing packages provided with an opening arrangement and of the type which has an emptying hole prepared in the package wall and through which the package is intended to be emptied of its contents, the method comprising the steps of:

coating one side of a web of paper or paperboard with a liquid-tight coating of plastic, and the other side with a foil of coating of metal which serves as oxygen gas barrier and which, by means of a layer of sealing plastic or other suitable adhesive, is bonded to the paper of paperboard web;

making emptying-preparatory holes in the thus coated paper or paperboard web to form a packaging blank, wherein the emptying-preparatory holes are made only partly through the coated paper or paperboard web from one side of the web by first cutting or burning incisions in the web along substantially closed lines in correspondence with the size, configuration and placing of each respective emptying hole on finished packages through the outer plastic coating and paper or paperboard layer down to, but not through, the subjacent metal foil or metal coating, removing the parts of the packaging blank located inside the incision lines for the formation of the emptying holes which, from the other side of the web, are still closed by the unruptured of intact metal foil or coating; and reforming the packaging blank provided with the holes into individual packages provided with opening arrangements.

2. A method of producing packages provided with an opening arrangement and of the type which has an emptying hole prepared in the package wall and through which the package is intended to be emptied of its contents, the method comprising the steps of:

coating one side of a web of paper or paperboard with a liquid-tight coating of plastic, and the other side with a foil of coating of metal which serves as oxygen gas barrier and which, by means of a layer of sealing plastic or other suitable adhesive, is bonded to the paper or paperboard web;

making emptying-preparatory holes in the thus coated paper or paperboard web to form a packaging blank, wherein the emptying-preparatory holes are made only partly through the coated paper or paperboard web from one side of the web by first cutting or burning incisions in the web along substantially closed lines in correspondence with the size, configuration and placing of each respective emptying hole on finished packages through the outer plastic coating and paper or paperboard layer down to, but not through the subjacent metal foil or metal coating, removing the parts of the packaging blank located inside the incision lines for the formation of the emptying holes which, from the other side the web, are still closed by the unruptured or intact metal foil or coating; and reforming the packaging blank provided with the holes into individual packages provided with opening arrangements, wherein the parts of the packaging blank located inside the incision lines are sucked or drawn away from the packaging blank with the aid of a vacuum.

3. A method of producing packages provided with an opening arrangement and of the type which has an emptying hole prepared in the package wall and through which the package is intended to be emptied of its contents, the method comprising the steps of;

coating one side of a web of paper or paperboard with a liquid-tight coating of plastic, and the other side with a foil or coating of metal which serves as oxygen gas barrier and which, by means of a layer of sealing plastic or other suitable adhesive, is bonded to the paper or paperboard web;

making emptying-preparatory holes in the thus coated paper or paperboard web to form a packaging blank, wherein the emptying-preparatory holes are made only partly through the coated paper or paperboard web from one side of the web by first cutting or burning incisions in the web along substantially closed lines in correspondence with the size, configuration and placing of each respective emptying hole on finished packages through the outer plastic coating and paper or paperboard layer down to, but not through, the subjacent metal foil or metal coating, removing the parts of the packaging blank located inside the incision lines for the formation of the emptying holes which, from the other side of the web, are still closed by the unruptured or intact metal foil or coating; and reforming the packaging blank provided with the holes into individual packages provided with opening arrangements, wherein the packaging blank is heated selectively within the regions of the parts defined by the incision lines immediately prior to and/or in connection with these parts being removed from the packaging blank.

4. The method as claimed in claim 3, wherein the selective heating of the packaging blank is realized by inductive heating of the metal foil or coating in the packaging blank.

5. The method as claimed in claim 3, wherein the packaging blank is heated to a temperature at which the layer of sealing plastic or other adhesive wholly or at least partly melts.

6. The method as claimed in claim 1, wherein the packaging blank is cut by means of laser of adapted wavelength and intensity in order to cut down to, but not through, the metal foil or metal coating of the packaging blank.

7. The method as claimed in claim 1, wherein the packaging blank is provided with separate pull-off opening strips above the partly provided emptying holes, before the packaging blank is reformed into packages.

8. The method as claimed in claim 1, wherein the produced packages are provided with separate opening arrangements on the outside of the packages in the region of the prepared emptying holes.

9. A package provided with an opening arrangement and of the type which has an emptying hole prepared in the package wall, through which the package is intended to be emptied of its contents, wherein the package is produced from a packaging material comprising a layer of paper or paperboard which, on the outside of the package, has a liquid-tight coating of plastic and, on the inside of the package, has a metal foil or coating serving as oxygen gas barrier, said emptying hole being made only partly through the layer of coated paper or paperboard with incisions in the layer of coated paper or paperboard along substantially closed lines in correspondence with the size, configuration and placing of said emptying hole to form a packaging blank, and with parts of said packaging blank located inside the incision lines being removed from said packaging blank; and the emptying hole prepared in the package wall is closed from the inside by the unruptured or intact metal foil or coating in the packaging material.

* * * * *